US011595771B2

(12) United States Patent
Weijand et al.

(10) Patent No.: US 11,595,771 B2
(45) **Date of Patent: *Feb. 28, 2023**

(54) METHOD AND DEVICE FOR RECOGNITION AND ARBITRATION OF AN INPUT CONNECTION

(71) Applicant: Staton Techiya LLC, Lighthouse Point, FL (US)

(72) Inventors: Koen Weijand, Alfaz del Pi (ES); Steven W. Goldstein, Delray Beach, FL (US)

(73) Assignee: Staton Techiya, LLC, Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/338,665

(22) Filed: Jun. 4, 2021

(65) Prior Publication Data

US 2021/0297799 A1 Sep. 23, 2021

Related U.S. Application Data

(63) Continuation of application No. 16/933,825, filed on Jul. 20, 2020, now Pat. No. 11,089,417, which is a (Continued)

(51) Int. Cl.

| | |
|---|---|
| ***H01R 24/58*** | (2011.01) |
| ***H04R 29/00*** | (2006.01) |
| ***H04R 1/10*** | (2006.01) |

(52) U.S. Cl.

CPC ..... *H04R 29/001* (2013.01); *H04R 1/1041* (2013.01); *H01R 24/58* (2013.01); *H04R 2420/05* (2013.01); *H04R 2420/09* (2013.01)

(58) Field of Classification Search

CPC ..... H04R 29/001; H04R 1/1041; H04R 2420/05; H04R 2420/09; H01R 24/58 (Continued)

(56) References Cited

U.S. PATENT DOCUMENTS

| | | | |
|---|---|---|---|
| 3,876,843 | A | 4/1975 | Moen |
| 4,054,749 | A | 10/1977 | Suzuki et al. |

(Continued)

FOREIGN PATENT DOCUMENTS

| | | | |
|---|---|---|---|
| CN | 104519441 | | 4/2019 |
| EP | 1519625 | A2 | 3/2005 |
| WO | 2006037156 | A1 | 4/2006 |

OTHER PUBLICATIONS

Olwal, A. and Feiner S. Interaction Techniques Using Prosodic Features of Speech and Audio Localization. Proceedings of IUI 2005 (International Conference on Intelligent User Interfaces), San Diego, CA, Jan. 9-12, 2005, p. 284-286.

(Continued)

*Primary Examiner* — Vivian C Chin
*Assistant Examiner* — Friedrich Fahnert
(74) *Attorney, Agent, or Firm* — Akerman LLP; Peter A. Chiabotti

(57) ABSTRACT

Embodiments herein enable fast and easy interconnectivity among multimedia accessories including mobile devices and other devices. There is only limited space on mobile devices yet there are numerous input connectors. The standard TRRS audio jack is one such input that has and remains common, primarily because it is the accepted standard for audio input; namely, headphones and earpieces for listening purposes. Embodiments herein describe an intelligent switch to that audio jack that permits for additional backward and forward compatibility. It transparently allows a user to insert analog or digital audio devices, such as earphones, without the need to manually reconfigure device settings. The device herein automatically converts between input connector types using the same input convention present on their existing mobile devices. Other embodiments are disclosed.

20 Claims, 7 Drawing Sheets

400

Related U.S. Application Data continuation of application No. 16/579,567, filed on Sep. 23, 2019, now Pat. No. 10,820,128, which is a continuation of application No. 16/047,547, filed on Jul. 27, 2018, now Pat. No. 10,425,754, which is a continuation of application No. 14/523,206, filed on Oct. 24, 2014, now Pat. No. 10,045,135.

(60) Provisional application No. 61/894,970, filed on Oct. 24, 2013.

(58) Field of Classification Search
USPC ..... 381/123
See application file for complete search history.

(56) References Cited

U.S. PATENT DOCUMENTS 4,088,849 A 5/1978 Usami et al.
4,947,440 A 8/1990 Bateman et al.
5,208,867 A 5/1993 Stites, III
5,267,321 A 11/1993 Langberg
5,524,056 A 6/1996 Killion et al.
5,903,868 A 5/1999 Yuen et al.
5,978,759 A 11/1999 Tsushima et al.
6,021,207 A 2/2000 Puthuff et al.
6,021,325 A 2/2000 Hall
6,163,338 A 12/2000 Johnson et al.
6,163,508 A 12/2000 Kim et al.
6,226,389 B1 5/2001 Lemelson et al.
6,289,311 B1 9/2001 Omori et al.
6,298,323 B1 10/2001 Kaemmerer
6,359,993 B2 3/2002 Brimhall
6,400,652 B1 6/2002 Goldberg et al.
6,415,034 B1 7/2002 Hietanen
6,567,524 B1 5/2003 Svean et al.
RE38,351 E 12/2003 Iseberg et al.
6,661,901 B1 12/2003 Svean et al.
6,681,202 B1 1/2004 Miet
6,683,965 B1 1/2004 Sapiejewski
6,728,385 B2 4/2004 Kvaloy et al.
6,748,238 B1 6/2004 Lau
6,754,359 B1 6/2004 Svean et al.
6,804,638 B2 10/2004 Fiedler
6,804,643 B1 10/2004 Kiss
6,829,360 B1 12/2004 Iwata et al.
6,856,046 B1 * 2/2005 Scarlett ..... H01R 29/00 439/668
6,895,375 B2 5/2005 Malah et al.
7,072,482 B2 7/2006 Doom et al.
7,107,109 B1 9/2006 Nathan et al.
7,181,402 B2 2/2007 Jax et al.
7,209,569 B2 4/2007 Boesen
7,233,969 B2 6/2007 Rawlins et al.
7,397,867 B2 7/2008 Moore et al.
7,430,299 B2 9/2008 Armstrong et al.
7,433,714 B2 10/2008 Howard et al.
7,433,910 B2 10/2008 Rawlins et al.
7,450,730 B2 11/2008 Bertg et al.
7,454,453 B2 11/2008 Rawlins et al.
7,477,756 B2 1/2009 Wickstrom et al.
7,546,237 B2 6/2009 Nongpiur et al.
7,562,020 B2 6/2009 Le et al.
7,599,840 B2 10/2009 Mehrotra et al.
7,693,709 B2 4/2010 Thumpudi et al.
7,727,029 B2 6/2010 Bolin et al.
7,756,285 B2 7/2010 Sjursen et al.
7,778,434 B2 8/2010 Juneau et al.
7,792,680 B2 9/2010 Iser et al.
7,831,434 B2 11/2010 Mehrotra et al.
7,920,557 B2 4/2011 Moote
7,953,604 B2 5/2011 Mehrotra et al.
7,991,815 B2 8/2011 Rawlins et al.
8,014,553 B2 9/2011 Radivojevic et al.
8,090,120 B2 1/2012 Seefeldt
8,155,326 B2 4/2012 Schweitzer et al.
8,162,697 B1 4/2012 Menolotto et al.
8,190,425 B2 5/2012 Mehrotra et al.
8,199,933 B2 6/2012 Seefeldt
8,200,499 B2 6/2012 Nongpiur et al.
8,206,181 B2 6/2012 Steijner et al.
8,332,210 B2 12/2012 Nilsson et al.
8,358,617 B2 1/2013 El-Maleh et al.
8,386,243 B2 2/2013 Nilsson et al.
8,437,482 B2 5/2013 Seefeldt et al.
8,493,204 B2 7/2013 Wong et al.
8,554,569 B2 10/2013 Chen et al.
8,639,502 B1 1/2014 Boucheron et al.
8,731,923 B2 5/2014 Shu
8,750,295 B2 6/2014 Liron
8,771,021 B2 7/2014 Edeler et al.
8,831,267 B2 9/2014 Annacone
9,037,458 B2 5/2015 Park et al.
9,123,343 B2 9/2015 Kurki-Suonio
9,135,797 B2 9/2015 Couper et al.
10,045,135 B2 8/2018 Weijand et al.
2001/0046304 A1 11/2001 Rast
2002/0106091 A1 8/2002 Furst et al.
2002/0116196 A1 8/2002 Tran
2002/0118798 A1 8/2002 Langhart et al.
2003/0093279 A1 5/2003 Malah
2003/0161097 A1 8/2003 Le et al.
2003/0165246 A1 9/2003 Kvaloy et al.
2003/0220988 A1 * 11/2003 Hymel ..... G06F 13/385 719/321
2004/0042103 A1 3/2004 Mayer
2004/0076305 A1 4/2004 Santiago
2004/0109668 A1 6/2004 Stuckman
2004/0125965 A1 7/2004 Alberth, Jr. et al.
2004/0138876 A1 7/2004 Kallio et al.
2004/0190737 A1 9/2004 Kuhnel et al.
2004/0196992 A1 10/2004 Ryan
2004/0203351 A1 10/2004 Shearer et al.
2005/0004803 A1 1/2005 Smeets et al.
2005/0049863 A1 3/2005 Gong et al.
2005/0078838 A1 4/2005 Simon
2005/0123146 A1 6/2005 Voix et al.
2005/0288057 A1 12/2005 Lai et al.
2006/0067551 A1 3/2006 Cartwright et al.
2006/0083395 A1 4/2006 Allen et al.
2006/0092043 A1 5/2006 Lagassey
2006/0190245 A1 8/2006 Iser
2006/0195322 A1 8/2006 Broussard et al.
2006/0204014 A1 9/2006 Isenberg et al.
2007/0043563 A1 2/2007 Comerford et al.
2007/0055519 A1 3/2007 Seltzer et al.
2007/0078649 A1 4/2007 Hetherington et al.
2007/0086600 A1 4/2007 Boesen
2007/0189544 A1 8/2007 Rosenberg
2007/0237342 A1 10/2007 Agranat
2007/0291953 A1 12/2007 Ngia et al.
2008/0031475 A1 2/2008 Goldstein
2008/0037801 A1 2/2008 Alves et al.
2008/0165988 A1 7/2008 Terlizzi et al.
2008/0208575 A1 8/2008 Laaksonen
2008/0219456 A1 9/2008 Goldstein
2008/0300866 A1 12/2008 Mukhtar
2009/0010456 A1 1/2009 Goldstein et al.
2009/0024234 A1 1/2009 Archibald
2009/0048846 A1 2/2009 Smaragdis et al.
2009/0129619 A1 5/2009 Nordahn
2009/0296952 A1 12/2009 Pantfoerder
2010/0061564 A1 3/2010 Clemow et al.
2010/0074451 A1 3/2010 Usher et al.
2010/0080379 A1 * 4/2010 Chen ..... H04M 1/6016 379/390.01
2010/0158269 A1 6/2010 Zhang
2010/0246831 A1 9/2010 Mahabub et al.
2010/0296668 A1 11/2010 Lee et al.
2011/0005828 A1 1/2011 Ye et al.
2011/0019838 A1 1/2011 Kaulberg et al.
2011/0096939 A1 4/2011 Ichimura
2011/0112845 A1 5/2011 Jasiuk et al.
2011/0188669 A1 8/2011 Lu
2011/0237110 A1 9/2011 Montena

(56) References Cited

U.S. PATENT DOCUMENTS

| | | | |
|---|---|---|---|
| 2011/0264447 | A1 | 10/2011 | Visser et al. |
| 2011/0282655 | A1 | 11/2011 | Endo |
| 2011/0293103 | A1 | 12/2011 | Park et al. |
| 2012/0046946 | A1 | 2/2012 | Shu |
| 2012/0121220 | A1 | 5/2012 | Krummrich |
| 2012/0128165 | A1 | 5/2012 | Visser et al. |
| 2012/0215519 | A1 | 8/2012 | Park et al. |
| 2012/0321097 | A1 | 12/2012 | Braho |
| 2013/0013300 | A1 | 1/2013 | Otani |
| 2013/0016869 | A1 | 1/2013 | Winther |
| 2013/0024191 | A1 | 1/2013 | Krutsch |
| 2013/0039512 | A1 | 2/2013 | Miyata et al. |
| 2013/0052873 | A1 | 2/2013 | Riezebos et al. |
| 2013/0244485 | A1 | 3/2013 | Lam et al. |
| 2013/0108064 | A1 | 5/2013 | Kocalar et al. |
| 2013/0195283 | A1 | 8/2013 | Larson et al. |
| 2013/0210286 | A1 | 8/2013 | Golko |
| 2013/0322653 | A1 | 12/2013 | Tsai et al. |
| 2014/0050330 | A1 | 2/2014 | Allen et al. |
| 2014/0072156 | A1 | 3/2014 | Kwon |
| 2014/0321673 | A1 | 10/2014 | Seo et al. |
| 2015/0089288 | A1 | 3/2015 | Overby |
| 2015/0117663 | A1 | 4/2015 | Hsu et al. |
| 2015/0156584 | A1 | 6/2015 | Chen et al. |
| 2015/0358719 | A1 | 12/2015 | Mackay et al. |
| 2016/0063986 | A1* | 3/2016 | Ben-Ami ..... G10K 11/17857 381/71.6 |
| 2016/0104452 | A1 | 4/2016 | Guan et al. |
| 2017/0127203 | A1* | 5/2017 | Ryu ..... H04R 5/04 |
| 2021/0084413 | A1* | 3/2021 | Skjoldborg ..... H04R 1/1008 |

OTHER PUBLICATIONS

Bernard Widrow, John R. Glover Jr., John M. McCool, John Kaunitz, Charles S. Williams, Robert H. Hearn, James R. Zeidler, Eugene Dong Jr, and Robert C. Goodlin, Adaptive Noise Cancelling: Principles and Applications, Proceedings of the IEEE, vol. 63, No. 12, Dec. 1975.

Mauro Dentino, John M. McCool, and Bernard Widrow, Adaptive Filtering in the Frequency Domain, Proceedings of the IEEE, vol. 66, No. 12, Dec. 1978.

* cited by examiner

200

300

400

METHOD AND DEVICE FOR RECOGNITION AND ARBITRATION OF AN INPUT CONNECTION

CROSS-REFERENCE TO RELATED APPLICATION(S)

This application is a continuation of and claims priority to U.S. patent application Ser. No. 16/933,825 filed Jul. 20, 2020, which is a continuation of and claims priority to U.S. patent application Ser. No. 16/579,567 filed on Sep. 23, 2019, which is a continuation of and claims priority to U.S. patent application Ser. No. 16/047,547 filed on Jul. 27, 2018, which is a continuation of and claims priority to U.S. patent application Ser. No. 14/523,206 filed on Oct. 24, 2014, now U.S. Pat. No. 10,045,135 which claims priority to U.S. Provisional Patent Application No. 61/894,970, filed on Oct. 24, 2013, each of which are incorporated herein by reference in their entireties.

FIELD OF THE INVENTION

The present embodiments relate to multimedia devices, and more particularly, though not exclusively, to electronic conversion between audio input receptive connector types of a mobile device.

BACKGROUND

Mobile devices providing various multimedia access and connectivity are becoming ubiquitous. These devices may implement expansion capabilities for various connectors to support various multimedia interfaces. Most interface types require different physical connectors each occupying limited device space, and each connection with its own interface requirements. One example of an audio input connector is a Tip, Ring, Ring, Sleeve (TRRS) input connector having distinct contacts capable of conducting analog signals. Consumer electronics, such as a mobile communication device, use a version of the TRS connector commonly known as the mini plug. With mobile devices becoming smaller, yet exposing more user interface functionality, there is a need to limit the number of available connector interfaces, yet support only a minimum number of connector types and provide interoperability among the connector protocols.

With increased widespread use of mobile device there also exists a need for fast and easy interconnectivity among multimedia accessories. There is only limited space on mobile devices yet there are numerous input connectors. The standard TRRS audio jack is one such input that has and remains common, primarily because it is the accepted standard for audio input; namely, headphones and earpieces for listening purposes.

DETAILED DESCRIPTION

Figure 1A:
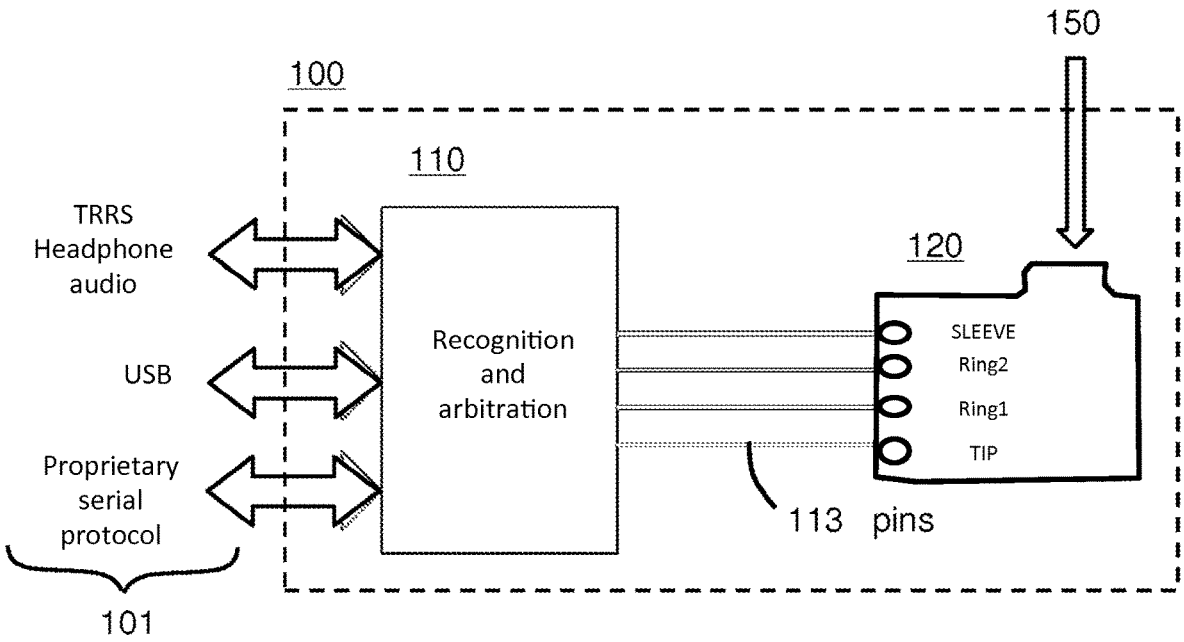
FIG. 1A is an illustration of a system for recognition and arbitration for universal connections in accordance with an exemplary embodiment.

The following description of at least one exemplary embodiment is merely illustrative in nature and is in no way intended to limit the invention, its application, or uses. Similar reference numerals and letters refer to similar items in the following figures, and thus once an item is defined in one figure, it may not be discussed for following figures.

Herein provided is an intelligent switch to that audio jack that permits for additional backward and forward compatibility. It transparently allows a user to insert analog or digital audio devices, such as earphones, without the need to manually reconfigure device settings. The device herein automatically converts between input connector types using the same input convention present on their existing mobile devices.

Referring to FIG. 1A, a system 100 for recognition and arbitration for universal connectivity in accordance with one embodiment is shown. The system 100 comprises a processing unit 110 and an audio jack 120. The system 100 by way of the audio jack 120 receives as input/output (110) the audio connector 150 (see FIG. 1B) and various multimedia connections 101. As an example, the selectable multimedia connection 101 can be, but not limited to, one of a headphone connector, earpiece connector, USB port, or proprietary serial protocol. In certain arrangements the TRRS headphone audio in the multimedia connections 101 may also be tied to the audio jack 120; that is, it may be under a same hardwired connection. In other configurations, these two inputs may be independent and separate.

The processing unit 110 is communicatively coupled to the audio jack 120 to provide for automatic recognition and arbitration to support the various multimedia connections 101. The multimedia connections 101 may be internal to a device implementing functionality of the processing unit 110, or a physical integration of the processing unit 110 within a host device platform. In such arrangement, the multimedia connectors 101, if not provided by the underling platform, can be exposed by and through the audio jack 120. Among other functions, the processing unit 110 arbitrates and negotiates multimedia connections and converts between multimedia types and formats to provide for universal connectivity.

As will be described ahead, the processing unit 110 also provides backward compatibility and interoperability with existing multimedia functions available to a host platform, for example, a multimedia device integrating the processing unit 110, such as a mobile device (see FIG. 3A), for expanding its multimedia capabilities. This can include power management and or signal conditioning for delegation of handshake protocols to implement multimedia interoperability and communication. It can further provide bi-directional hosting through the audio jack 120 thereby permitting for a swapping of host and slave configurations when setting up a device (e.g., USB OTG) and multimedia sessions (e.g. SIP, RTP, UDP, etc.). In other configurations, it can provide bi-directional power, for example, to allow separately powered devices to charge using power from the attached device. As will be explained also ahead in further detail, the system 100 provides multidrop capabilities through a data and addressing buffer where components connected to the same line (e.g., pin of the TRRS) undergo, by way of the processing unit 110, a process of arbitration to detect and schedule device data communications to registered listening channels (e.g., data streams, data lines, busses, etc.) thereto connected.

Still referring to FIG. 1A, the audio jack 120 can be a standard analog input jack, yet, through configuration of the processing unit 110, provides a universal conversion interface (adaptor) to other digital formats where required. For example, a digital headphone (or analog for that matter) can be inserted into the audio jack 120, and upon its detection by the processing unit 110, can receive digital audio data from other coupled multimedia inputs through the audio jack 120, for example, audio converted from a USB device communicatively coupled thereto or other proprietary serial interfaces. It also provides for bi-directional communication, for instance, to download microphone signals from the attached headset and store directly to the attached USB device by way of a conversion protocol. The bi-directional communication may be relay on separate pin 113 lines, or be interleaved in packet data format among multiple pins 113. Additionally, as explained ahead in further detail ahead, the processing unit 110 can certify and authenticate the attached multimedia device (e.g., headset, earphones, etc.) for registration purposes and/or for setting up communication with a service offering of the underlying platform (e.g., voice communication, music listening, gaming, social media, etc.).

Figure 1B:
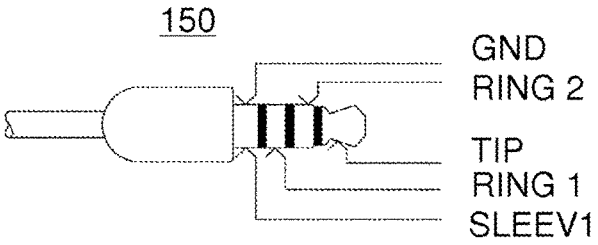
FIG. 1B is an audio input connector utilized in conjunction with the system of FIG. 1A in accordance with an exemplary embodiment.

Notably, the processing unit 110 automatically detects the type of input, for example a headset, whether digital or analog, and converts corresponding audio data, to, or from, other multimedia inputs or outputs. For instance, the audio jack 120 can be one such selectable multimedia connection and is a physical plug. The "mini" connector has a diameter of 3.5 mm (approx. ⅛ inch) and the "sub-mini" connector has a diameter of 2.5 mm (approx. 3/32 inch). The corresponding audio input connector 150 for the input jack 120 is shown in FIG. 1B. It is a physical plug comprising a Tip, Ring, Ring, Sleeve (TRRS) input connector, common for connector types used for analog signals, primarily audio. Various models supported herein are stereo plug, mini-stereo, microphone jack and headphone jack.

As previously noted, the system 100 by way of the processing unit 110 providing analog switching in conjunction with digital format conversion. This provides for backward and forwards compatibility with respect to previous and current connector types. For instance, the system 100 will operate and manage input connectivity seamlessly whether it is conventional earphones that are inserted into the audio jack 120, or digital earphones that are inserted. That is, the system 100 automatically differentiates between the device interface types (e.g., analog, digital) and switches accordingly. As explained herein, the processing unit 110 can measure a current resistance or other loading of the signals placed on the TRRS sections of the audio jack 120, individually or in combination. Once the compatibility type is determined, the processing unit 110 can proceed to service the connection, for example, converting digital audio to analog waveforms if conventional headphones are used, or relaying and buffering digital packets only if digital earphones are used instead. Similarly, upon detection of a proprietary headset, for instance, using multiple microphones and speakers, the processing unit 110 can perform audio separation and segregation to fan out audio in the proprietary format, whether in digital or analog format, or a combination thereof, for delivering/receiving the audio to and from the headset.

In this manner, the multimedia device 300 is backward compatible with pre-existing audio input connectors and audio formats, and also forward compatible with respect to proprietary or new devices. In the latter, it should be noted, that additional software functionality can also be downloaded into the multimedia device 300 as necessary, or upon user request, to obtain additional updates to a proprietary protocol where required. For instance, the processing unit 110 upon detection a proprietary headset in the TRRS audio jack 120 with new features can convey a communication request to automatically download additional device drivers or other plug-ins to support new headset features if required. As an example, a headset with multiple speakers for 5 source surround sound capabilities inserted in the TRRS audio jack 120 used can be configured for use with a 2 source stereo applications, for instance, to enable surround sound from a stereo program. This is just one example, and it should be noted that more complex audio handling and processing features may be enabled for proprietary headsets mixing audio input/output, for instance, interleaving or overlaying microphone (input) signals with speaker (output) signals. That new software downloaded for use by the processing unit 110 then takes advantage of and exposes proprietary functionality of the headset.

With respect to the expressed embodiment illustrated in FIG. 1A, the system 100 by way of the processing unit 110 and audio jack 120 provides for TRRS connectivity with freely allocatable functions to each pin 113. That is, the processing unit 110, upon detection of the audio input connector type or signaling methodology through the audio jack 120, independently assigns or multiplexes data lines from, or to, the attached device (e.g., headset) to each of the pins, and where required, may override the default TRRS pin settings to establish data lines and implement protocols for the communication of data (uni or bi-directional), concurrently running applications, or other multimedia services or offerings as required by the user or as automatically determined when a client device is connected.

The system 100 as illustrated and by way of the audio jack 120 exposes 4 individual TRRS pin 113 functions that can be dynamically allocated to the TRRS connection. This dynamic configuration is managed by the processing unit 110 to actively support the four TTRS (data) lines, for example, but not limited to, microphone, USB, or proprietary data plus power signals. As an example, the processing unit 110 can detect the presence of an analog microphone signal and by way of switching logic redirect or reconfigure the TRRS pins for according use, for example, to assign a data channel for microphone input, or pin reassignment as necessary to connect the pin to the appropriate internal signal path. The processing unit 110 can override a pin configuration, for example, to assign a stereo pin to ground, or communicatively swap pins between stereo channels and the ground connection. Additionally, as previously mentioned, the processing unit 110 contains internal memory and processor architectures to provide data communication over bus lines, and with re-configurable logic, permits for bi-directional serial bus protocol with power including multidrop capabilities as will be explained ahead in FIG. 2.

Figure 1C:
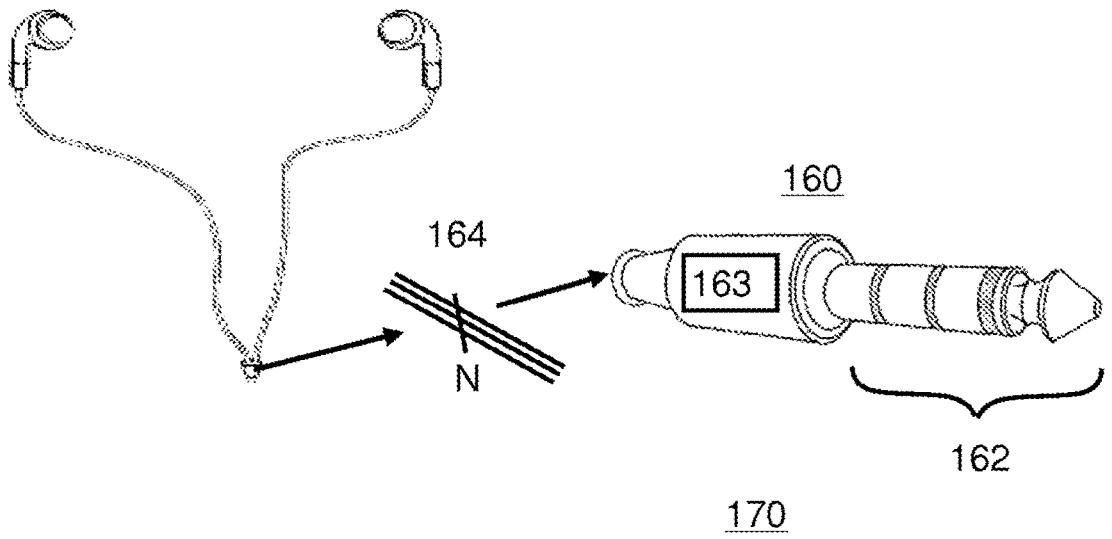
FIG. 1C is an illustration of a headset utilized in conjunction with the system of FIG. 1A in accordance with an exemplary embodiment.
Figure 1D:
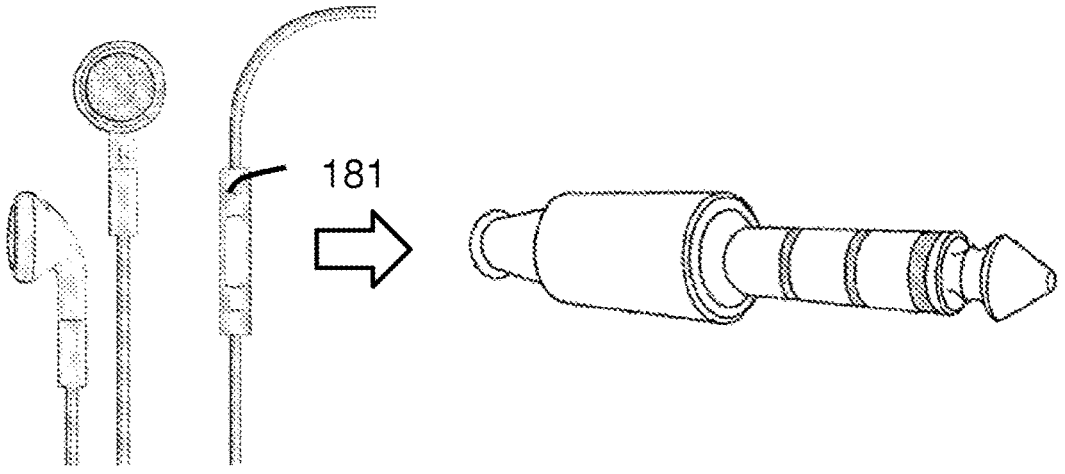
FIG. 1D is an illustration of an alternate headset with remote control and microphone functionality utilized in conjunction with the system of FIG. 1A in accordance with an exemplary embodiment.

Referring now to FIG. 1C, a headset 170 in accordance with one embodiment is shown. The headset 170 includes a wire, comprising N internal multi-wires 164, and an audio input connector 160. Although N=4 for the TRRS connector type, it should be noted that the audio input connector 160 can include a smart switch that converts and fans out signals into a larger number of wires. Moreover, it may be a standard 4 or 8 surface contact unit, or other number of contacts. The headset 170 can contain separate wires for each of the various electronic components of the headset 170, for example, including but not limited to, microphones, speakers, amplifiers,+/−, power and ground. There may also be multiple components, for example, an ear canal microphone, an ambient microphone, ear canal receiver for both the left and right ear. Referring briefly to FIG. 1D, an alternate embodiment of a headset 180 is shown. These headphones include an additional user interface component, user panel 181, including a volume knob, button or switch, and an illumination element therein.

The headset 170 by way of the audio connector 160, with respect to the illustration of FIG. 1A, can be plugged into the audio jack 120. The processing unit 110 when communicatively coupled to headset 170 by way of the audio input connector 160 automatically recognizes the type of headset 170, which includes detecting all components (e.g., microphones, speakers, etc. in the previous paragraph), and corresponding input/output (I/O) functionality, and other pre-inserted information (e.g., during manufacturing, pre/post programmed), and for example, whether data is conveyed in analog or digital format to the components, and all data lines or data streams, for example, if there are multiple microphones or speakers in the headset, and for each of the components. The recognition event may occur on connection and can include detection of loading, resistance, impedance or other electrical parameters of the attached headset 170 through the TRRS 162 connector of the audio input connector 160. As one example, the processing unit 110 can inject a line signal, voltage or current, into the audio jack 120 to assess system response of the attached device (e.g., headset 170), for example, but not herein limited to, loading or differential changes to phase, amplitude and modulation.

As an example, the processing unit 110 can detect the device input type (e.g., headset 170) including other identifying information, such as manufacturer, date, identifier, etc. and negotiate a communication connection with multimedia services exposed by the underlying communication platform. For instance, a processing unit 110 integrated with a mobile device offering and registered for listening services, for example, analogous to a Bluetooth handshake negotiation, may upon onset connection of the headset 161 identify it as a digital headset and through the audio jack of the TRRS 162 and convert the digital data received as an analog signal to a packet data format or other digital format compliant with the listening services expected by the underlying platform.

As illustrated in FIG. 1D, the user panel 181 may further include a TRRS mechanical switch such that ordinary analog type earphones can be driven and also the microphone signal can be acquired. In another arrangement, the mechanical switch, although shown on the headset 170 for this example, may instead be located on the system 100, for example, in conjunction with the TRRS jack 120 for such purpose. As one example, in combination with the TRRS jack 120, the insert slot may be configured to receive the audio input plug 150 at an extensible depth. At the default insertion depth, the audio input plug is mechanically coupled to receive analog audio over the TRRS connection surfaces. If the user then temporarily presses the audio input connector 150 slightly further into the audio jack 120 it will temporarily mechanically switch to connect the TRRS connection surfaces to a microphone line. In this way, the user can receive audio in default listening mode, but additionally, by way of pressing down on the input connector plug 150, active a microphone signal to permit for voice communication. Moreover, the logic of the processing unit 110, which provides for intelligent automatic detection of the audio input device, can recognize a proprietary headset providing both earphone speaker and microphone capabilities, and by way of the mechanical switch allow for adaptation of the proprietary headset for use as intended.

In another arrangement, the audio input connector 160 contains a communication component 163 to identify the connected device (e.g., headset). This component 163 may be an electronic component, for example, a simple electrical circuit with a known R, RL, RC circuit configuration or combination thereof, or an active electronic device, for example a Radio Frequency Identifier (RFID), or other inductive type interface including but not limited to electromagnet, magnetic or other field induced components. In this arrangement, the processing unit 110 will recognize the attached device, for example, from impedance matching, current signaling (e.g., DC), electrical reactance, loading, grounding or resistance. The component 163 although shown in the audio connector 160 may reside anywhere in the attached device (e.g., earpiece, Y connector, user input, volume circuit, etc.)

In another arrangement, the communication component 163 may be a digital chip or other integrated circuit that provides a digital signature identifying itself, and including functionality and parameters available to, or for configuring, the attached headset. In such an arrangement, the processing unit 110 detects the component 163 embedded within the headset, and either upon reading instructions from the chip, or upon active direction from the component 163, would inform and arbitrate a handshake communication or set up a protocol with the underlying platform (e.g., mobile device). In such an event, for example, the processing unit 110 can itself provide power management and communication services with the headset, or delegate such activities to the underlying host platform.

Figure 1E:
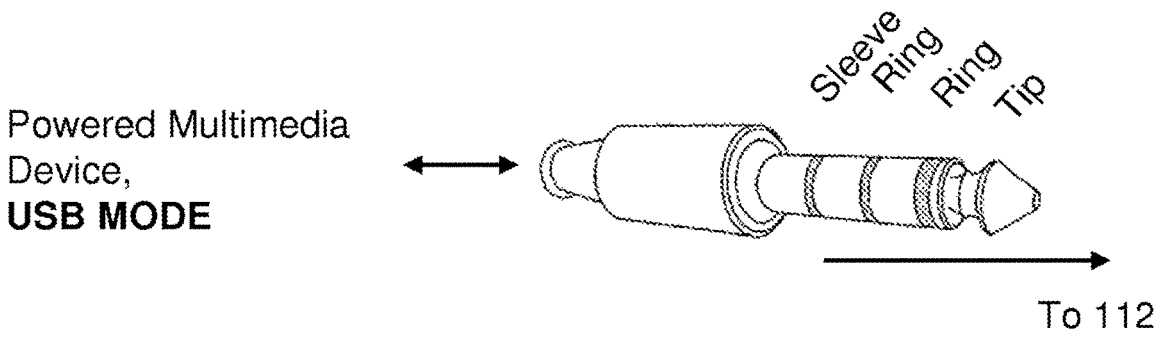
FIG. 1E is an illustration of TRRS connectivity for a powered multimedia device in USB Mode in accordance with an exemplary embodiment.

Referring to FIG. 1E, an illustration of TRRS connectivity via the audio jack 120 for a powered multimedia device in USB Mode in accordance with an exemplary embodiment is shown. In this arrangement, the input device is connected over the TRRS connection to receive power operating in a USB mode. For example, the input device may be one of a noise cancelling headphone, microphone, MP3 player, video camera, memory card or any low power (e.g., 5V) USB client, and is communicatively coupled, and powered by, the host device through the audio jack 120 (see FIG. 1A). In this configuration, the processing unit 110 determines the type of input device, and then negotiates the services required (e.g., USB power/connectivity) to operate the device and couple data communication to the host (e.g., mobile device, see FIG. 3A).

Figure 1F:
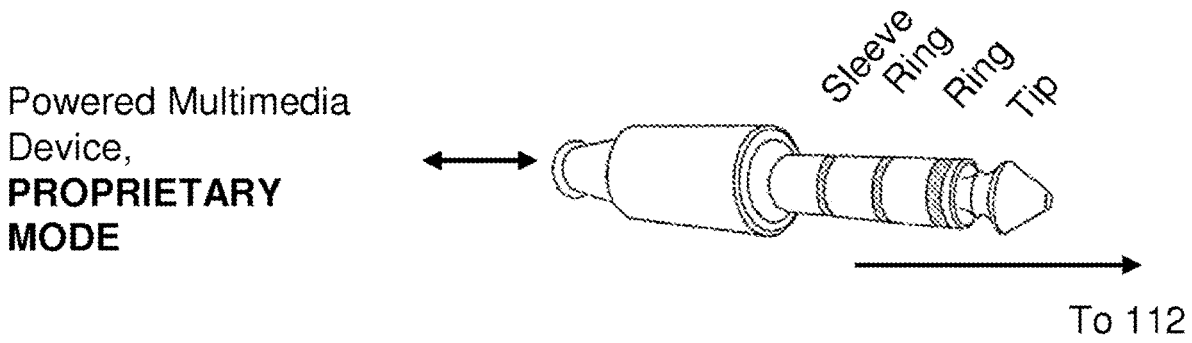
FIG. 1F is an illustration of TRRS connectivity for a powered multimedia device in Proprietary Mode in accordance with an exemplary embodiment.

Referring to FIG. 1F, an illustration of TRRS connectivity via the audio jack 120 for a powered multimedia device in Proprietary Mode in accordance with an exemplary embodiment is shown. In this arrangement, the input device is connected over the TRRS connection to receive power operating in a proprietary mode. For example, the input device may be a proprietary device (e.g., see earpiece 400 in FIG. 4) that requires certain proprietary requirements (e.g., 12V power, multiple audio lines, ground line, etc.) expressed via a proprietary protocol and data channel setup (see FIG. 2; data channel 200) to the host device through the audio jack 120 (see FIG. 1A). In this configuration, the processing unit 110 determines the type of proprietary input device, required access features (e.g., bandwidth, multi-channel, data rate, dynamic range, sample size, etc.) and then negotiates the services required (e.g., custom regulated power, data channels, connectivity) to operate the device and couple data communication to the host (e.g., mobile device, see FIG. 3A). One example for implementation of a proprietary protocol using a data channel is shown and described in FIG. 2 ahead.

A method for managing and delegating dynamic pm allocation of an audio jack responsive to connection of an audio device is provided. The method includes recognizing and arbitrating a TRRS dynamic pin allocation on the audio jack to accommodate various multimedia types implemented by the audio device or those supported by the underlying platform communicatively coupled thereto. The method automatically detects and negotiates multimedia connections and converts between multimedia types and formats to provide for connectivity support responsive to insertion of the audio device. Detection can be achieved by way of an audio connector with an identifier component inserted into the audio jack and/or by line signal sensing. In one embodiment, the audio jack is a TRRS audio input that can automatically reconfigure pin assignments and convert individual line signals thereon. Configurations for authentication, switching, hi-directionality, multidrop, USB powered and proprietary modes are provided. Other embodiments are disclosed.

Figure 2:
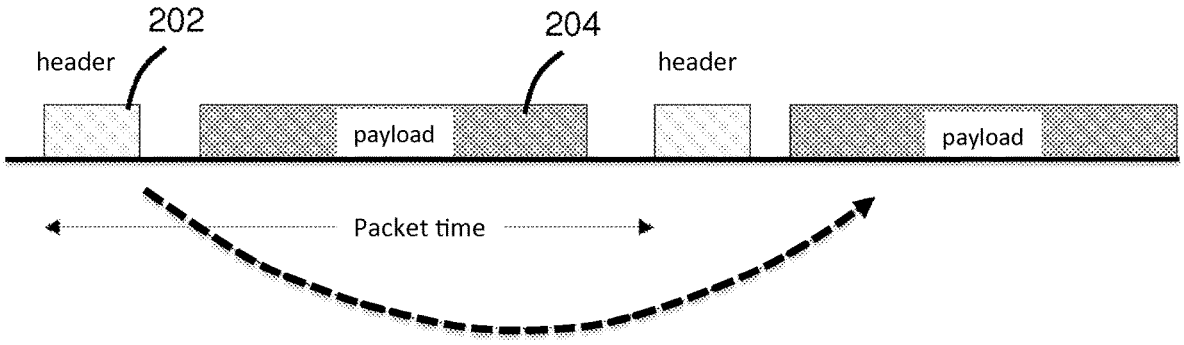
FIG. 2 is an illustration of a data channel for system communication in accordance with an exemplary embodiment.

FIG. 2 depicts a data channel 200 for system communication in accordance with an exemplary embodiment. The data channel 200 provides content over a time interleaved or frequency interleaved communication channel Though shown as a time sliced data channel for illustrative purposes, it may be time division or frequency division sliced. The data channel as shown is representative of a data line for one of the pins 113 shown in FIG. 1A; although may be multiplexed in other arrangements for multiple signal paths, for example, in order to accommodate multiple (e.g., 12) data lines from the headset 170 with respect to only 4 physical TRRS lines. As illustrated, a communication protocol configured by the processing unit 110 provides for scheduling and transmission of data packets over the data channel 200.

In one embodiment, the header 202 determines from the data packets on the data channel 200 the audio source (e.g., earpiece, headphone, microphone, memory card, video camera, etc.) followed by the payload 203 containing the audio data in one of a plurality of formats (e.g., MP3, AU, PCM, WAV, AIFF, etc.). The processing unit 110 reads the header to properly identify the format, bandwidth, overhead and other necessary for decoding and processing the audio data. With this information, the processing unit 110 can then arbitrate and schedule further data communication amongst multimedia services thereto connected or internally supported by the host platform. This may include delegating of master and slave roles between data communication end points, and allocation of bandwidth and processor time. As an example, the data source of the data channel 200 can be the bus master, or one of the earpieces of the headset 170, for example, the left or right channel In this arrangement, the TRRS connector side can serve as the bus master. Moreover, as an example, the data type identified by the header, in addition to other audio specific information, can be one of N microphones or M loudspeaker targets, or data for memory or local programming of one of the left or right clients. In an asynchronous arrangement, the header 202 can function as the clock source for audio subsystems.

Figure 3A:
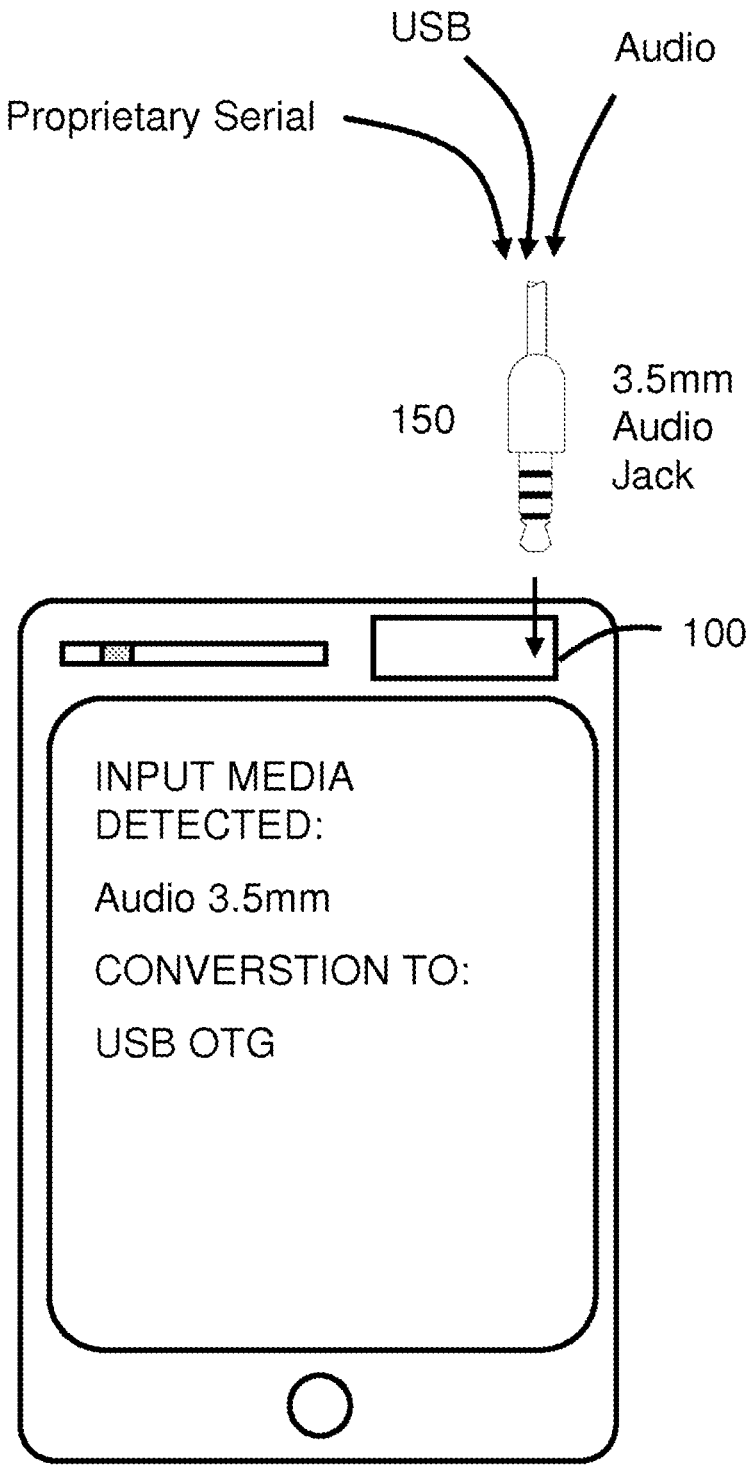
FIG. 3A is a mobile device integrating the system of FIG. 1A for recognition and arbitration of an audio connector in accordance with an exemplary embodiment.
Figure 3B:
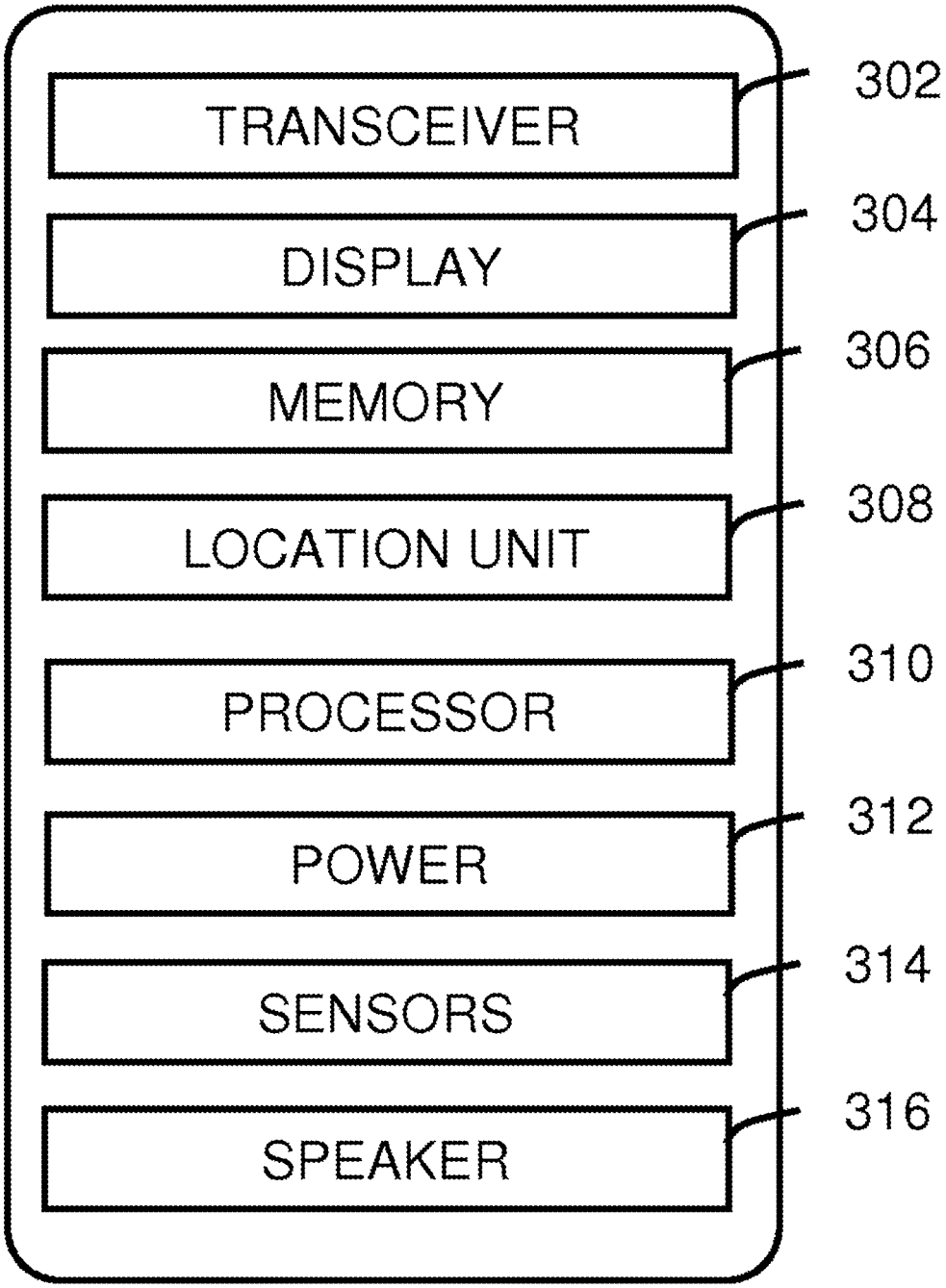
FIG. 3B is are exemplary components of the mobile device in FIG. 3A in accordance with an exemplary embodiment.

FIG. 3A depicts one exemplary embodiment of the system 100 of FIG. 1A contained within a multimedia device 300 for performing universal adaptation of the audio input connector 150 to support various multimedia input formats. In this manner, the multimedia device 300 can receive various multimedia input types, and, by way of the system 100 component integrated therein provide recognition and arbitration for universal connectivity; that is, automatically convert the media type into a suitable format for processing by the underling system. In one arrangement the audio input connector 150 has on one end has the audio input jack 120 and on the other end is adapted to fit any of the multimedia input types, including but not limited to, a proprietary serial connector, a USB connector and an audio input (e.g., headphone, earphone). That is, the wire cable itself may embody ends with different physical connector types. In another arrangement, a standard same end-to-end audio cable may be configured with a detachable adapter to fit each of the connecting devices, for example, a male-to-female USB to TRRS (2.5/3.5 mm) adapter.

As illustrated, the multimedia device 300 receives as input multimedia through the TRRS audio jack. In a first embodiment, the system 100 for recognizing and arbitrating the connectivity, is a first stage for the media processing. That is, the system 100 including the processing unit 110 is first responder to the audio jack 120, and then handles or delegates processing tasks for the switching and conversion. In a second embodiment, the system 100 acts as a service agent to the underling Operating System (OS) of the multimedia device 300; that is, it takes direction from the OS as needed to implement the switching functionality. For example, if the OS is configured with an internal switch to detect an analog earphone, it may elect to be the first responder to the audio input connection and handle and manage the connection. Alternatively, if the OS determines it is a different input convention, it may inquire the system 100 for its handling capabilities and then the OS can decide to delegate tasks based on response from the system 100. In this case, the system 100 does not override any of the OS behaviors without notice, thus preserving the same functionality originally intended, unless otherwise requested to expand upon.

The multimedia device 300 can be a mobile device, a media player, a portable display, or any other communication device. The processing unit 110 can consist of electronic hardware components and software or any combination thereof, for example, an integrated circuit, DSP, FPGA, etc. with embedded firmware or code, but not so limited. The processing unit 110 also provides backward compatibility to existing multimedia functionality that is currently available or provided by the multimedia device 300, for instance, secondary interface devices thereto connected, such as a USB device. In various communication arrangements the processing unit 110 may be communicatively coupled to a wired or wireless network for interacting with one or more other users, for example, in a peer-to-peer network, ad-hoc network, presence system or other social media network.

Although the processing unit 110 is shown as an integrated component of the multimedia device 300, and in such configuration can advantageously leverage the internal processing functionality and power management of the device 200, in another arrangement, the processing unit can be completely external with self-contained processing capabilities.

FIG. 38 depicts various components of the multimedia device 300, though is not limited to only those components shown. As illustrated, the device 300 comprises a wired and/or wireless transceiver 302, a user interface (UI) display 304, a memory 306, a location unit 308, and a processor 310 for managing operations thereof. The media device 300 can be any intelligent processing platform with Digital signal processing capabilities, application processor, data storage, display, input modality like touch-screen or keypad, microphones, speaker, Bluetooth, and connection to the internet via WAN, Wi-Fi, Ethernet or USB. This embodies custom hardware devices, Smartphone, cell phone, mobile device, iPad and iPod like devices, a laptop, a notebook, a tablet, or any other type of portable and mobile communication device. A power supply 312 provides energy for electronic components.

In one embodiment where the media device 300 operates in a landline environment, the transceiver 302 can utilize common wire-line access technology to support POTS or VoIP services. In a wireless communications setting, the transceiver 302 can utilize common technologies to support singly or in combination any number of wireless access technologies including without limitation Bluetooth™ Wireless Fidelity (WiFi), Worldwide Interoperability for Microwave Access (WiMAX), Ultra Wide Band (UWB), software defined radio (SOR), and cellular access technologies such as CDMA-1X, W-CDMA/HSDPA, GSM/GPRS, EDGE, TOMA/EDGE, and EVDO. SDR can be utilized for accessing a public or private communication spectrum according to any number of communication protocols that can be dynamically downloaded over-the-air to the communication device. It should be noted also that next generation wireless access technologies can be applied to the present disclosure.

The power supply 312 can utilize common power management technologies such as power from USB, replaceable batteries, supply regulation technologies, and charging system technologies for supplying energy to the components of the communication device and to facilitate portable applications. In stationary applications, the power supply 312 can be modified so as to extract energy from a common wall outlet and thereby supply DC power to the components of the communication device 300.

The location unit 308 can utilize common technology such as a GPS (Global Positioning System) receiver that can intercept satellite signals and there from determine a location fix of the portable device 300.

The controller processor 310 can utilize computing technologies such as a microprocessor and/or digital signal processor (DSP) with associated storage memory such a Flash, ROM, RAM, SRAM, DRAM or other like technologies for controlling operations of the aforementioned components of the communication device.

Figure 4:
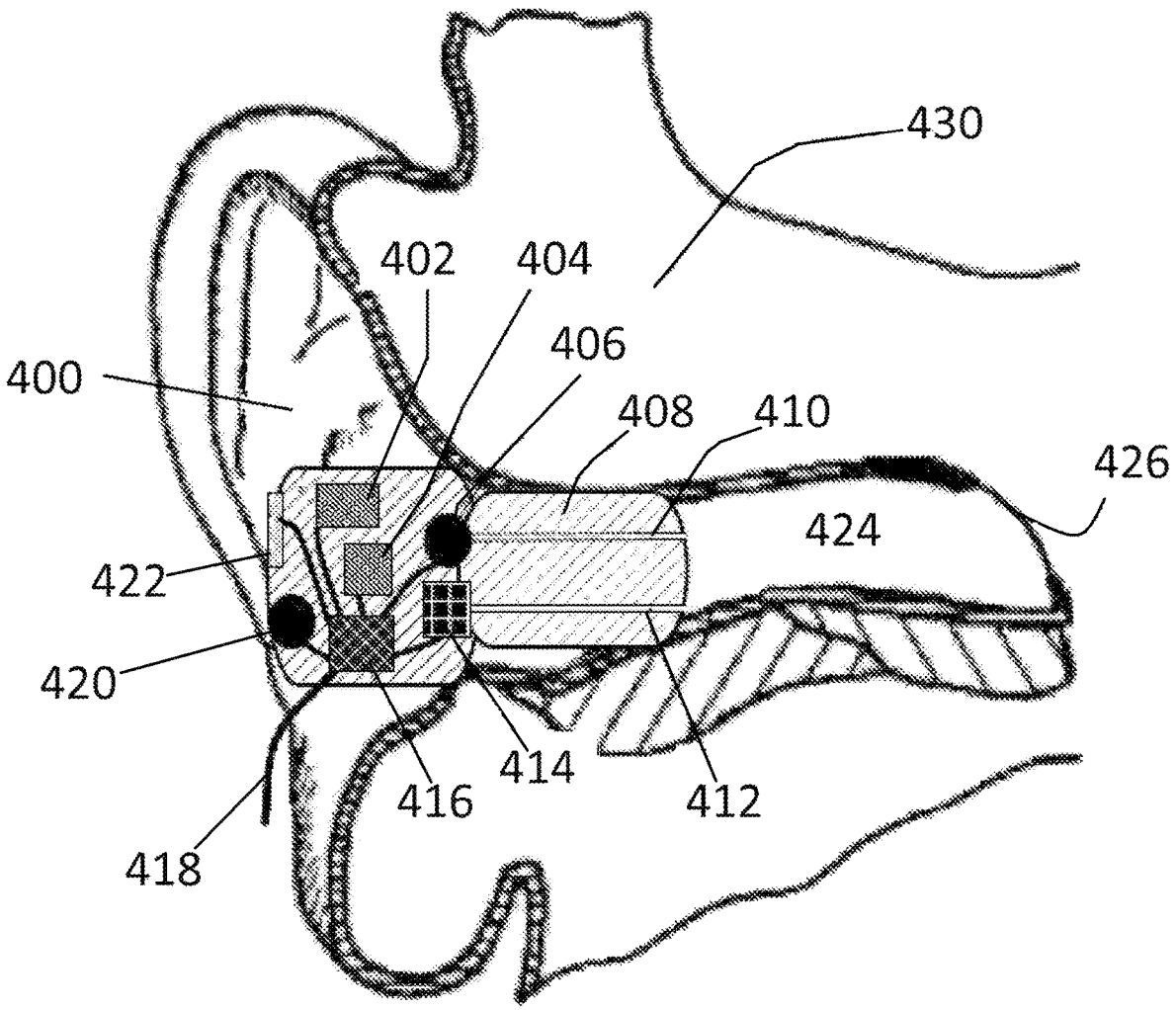
FIG. 4 is an exemplary earpiece for use with the system of FIG. 1A in accordance with an exemplary embodiment.

FIG. 4 is an illustration of an earpiece device 400 that can be connected to the system 100 of FIG. 1A as one of the audio devices for which the system 100 will recognize and arbitrate input connectivity among multiple media inputs 101. As will be explained ahead, the earpiece 400 contains numerous electronic components, many audio related, each with separate data lines conveying audio data. Briefly referring back to FIG. 1C, the headset 170 can include a separate earpiece 400 for both the left and right ear. In such arrangement, there may be anywhere from 8 to 12 data lines, each containing audio, and other control information (e.g., power, ground, signaling, etc.)

As illustrated, the earpiece 400 comprises an electronic housing unit 400 and a sealing unit 408. The earpiece depicts an electro-acoustical assembly for an in-the-ear acoustic assembly, as it would typically be placed in an ear canal 424 of a user 430. The earpiece can be an in the ear earpiece, behind the ear earpiece, receiver in the ear, partial-fit device, or any other suitable earpiece type. The earpiece can partially or fully occlude ear canal 424, and is suitable for use with users having healthy or abnormal auditory functioning.

The earpiece includes an Ambient Sound Microphone (ASM) 420 to capture ambient sound, an Ear Canal Receiver (ECR) 414 to deliver audio to an ear canal 424, and an Ear Canal Microphone (ECM) 406 to capture and assess a sound exposure level within the ear canal 424. The earpiece can partially or fully occlude the ear canal 424 to provide various degrees of acoustic isolation. In at least one exemplary embodiment, assembly is designed to be inserted into the users ear canal 424, and to form an acoustic seal with the walls of the ear canal 424 at a location between the entrance to the ear canal424 and the tympanic membrane (or ear drum). In general, such a seal is typically achieved by means of a soft and compliant housing of sealing unit 408.

Sealing unit 408 is an acoustic barrier having a first side corresponding to ear canal 424 and a second side corresponding to the ambient environment. In at least one exemplary embodiment, sealing unit 408 includes an ear canal microphone tube 410 and an ear canal receiver tube 414. Sealing unit 408 creates a closed cavity of approximately 5 cc between the first side of sealing unit 408 and the tympanic membrane in ear canal 424. As a result of this sealing, the ECR (speaker) 414 is able to generate a full range bass response when reproducing sounds for the user. This seal also serves to significantly reduce the sound pressure level at the users eardrum resulting from the sound field at the entrance to the ear canal 424. This seal is also a basis for a sound isolating performance of the electro-acoustic assembly.

In at least one exemplary embodiment and in broader context, the second side of sealing unit 408 corresponds to the earpiece, electronic housing unit 400, and ambient sound microphone 420 that is exposed to the ambient environment. Ambient sound microphone 420 receives ambient sound from the ambient environment around the user.

Electronic housing unit 400 houses system components such as a microprocessor 416, memory 404, battery 402, ECM 406, ASM 420, ECR, 414, and user interface 422. Microprocessor 416 (or processor 416) can be a logic circuit, a digital signal processor, controller, or the like for performing calculations and operations for the earpiece. Microprocessor 416 is operatively coupled to memory 404, ECM 406, ASM 420, ECR 414, and user interface 420. A wire 418 provides an external connection to the earpiece. Battery 402 powers the circuits and transducers of the earpiece. Battery 402 can be a rechargeable or replaceable battery.

In at least one exemplary embodiment, electronic housing unit 400 is adjacent to sealing unit 408. Openings in electronic housing unit 400 receive ECM tube 410 and ECR tube 412 to respectively couple to ECM 406 and ECR 414. ECR tube 412 and ECM tube 410 acoustically couple signals to and from ear canal 424. For example, ECR outputs an acoustic signal through ECR tube 412 and into ear canal424 where it is received by the tympanic membrane of the user of the earpiece. Conversely, ECM 414 receives an acoustic signal present in ear canal 424 though ECM tube 410. All transducers shown can receive or transmit audio signals to a processor 416 that undertakes audio signal processing and provides a transceiver for audio via the wired (wire 418) or a wireless communication path.

While the present embodiments have been described with reference to exemplary examples, it is to be understood that the embodiments are not limited to the disclosed exemplary embodiments. The scope of the following claims is to be accorded the broadest interpretation so as to encompass all modifications, equivalent structures and functions of the relevant exemplary embodiments. Thus, the description of the embodiments is merely exemplary in nature and, thus, variations that do not depart from the gist of the embodiments are intended to be within the scope of the exemplary embodiments herein. Such variations are not to be regarded as a departure from the spirit and scope of the present embodiments.

What is claimed is:

1. A device comprising:

a connection port configured to accept a Tip, Ring, Ring, Sleeve (TRRS) connector, wherein the connection port is attached to four pins, one pin each configured to electronically connected with the Tip, Ring, Ring, and Sleeve totaling the four pins;

a memory that stores instructions;

a processor configured to execute the instructions to perform operations, comprising:

receiving data from the four pins;

detecting an audio device by using the data from the four pins; and assigning data lines to or from the audio device through the four pins.

2. The device according to claim 1, wherein the data lines can be used to charge batteries of the audio device.

3. The device according to claim 1, wherein the operations further comprise:

separating the data from the four pins into analog signals and digital signals.

4. The device according to claim 3, wherein the operations further comprise:

converting at least one of the analog signals into a digital signal.

5. The device of claim 1, wherein the operations further comprise detecting an audio configuration of the audio device by way of current and load sensing through the connection port.

6. The device of claim 1, wherein the operations further comprise:

recognizing a dynamic pin allocation on an audio jack of the audio device.

7. The device of claim 6, wherein the operations further comprise:

arbitrating the dynamic pin allocation on the audio jack to accommodate a multimedia type of the audio device.

8. The device of claim 7, wherein the operations further comprise:

providing connectivity support in response to insertion of the audio device into the device.

9. The device of claim 1, wherein the operations further comprise:

reconfiguring at least one pin upon detection of a microphone signal.

10. The device of claim 1, wherein the operations further comprise:

multiplexing a data line on one pin with another data line of another pin of the device.

11. The device of claim 1, wherein the operations further comprise:

overriding a default TTRS (Tip, Ring, Ring and Sleeve) pin setting to establish a data line.

12. The device of claim 1, wherein the operations further comprise:

implementing a protocol for communication of data, executing an application, or a combination thereof, when the audio device is connected to the device.

13. The device of claim 1, wherein the operations further comprise:

providing analog switching in conjunction with digital format conversion.

14. The device of claim 1, wherein the operations further comprise:

reconfiguring at least one pin upon detecting a microphone signal.

15. The device of claim 1, wherein the operations further comprise:

negotiating a communication connection with a multimedia service.

16. The device of claim 1, wherein the operations further comprise:

converting between multimedia types and formats.

17. The device of claim 1, wherein the operations further comprise:

relaying and buffering digital packets if the audio device is a digital earphone.

18. The device of claim 1, wherein the operations further comprise:

interleaving or overlaying a detected microphone signal with a speaker signal.

19. The device of claim 1, further comprising:

injecting a line signal, voltage, or current into the audio jack to assess a response of the audio device.

20. The device of claim 1, further comprising:

conveying a communication request to automatically download device drivers or plug-ins to support the audio device.

* * * * *